US008202816B2

(12) United States Patent
Long et al.

(10) Patent No.: US 8,202,816 B2
(45) Date of Patent: Jun. 19, 2012

(54) DESULFURIZING ADSORBENT, PREPARING PROCESS AND USE THEREOF

(75) Inventors: Jun Long, Beijing (CN); Huiping Tian, Beijing (CN); Wei Lin, Beijing (CN)

(73) Assignees: China Petroleum & Chemical Corporation, Beijing (CN); Research Institute of Petroleum Processing, Sinopec, Beijing (CN)

( * ) Notice: Subject to any disclaimer, the term of this patent is extended or adjusted under 35 U.S.C. 154(b) by 378 days.

(21) Appl. No.: 12/468,346

(22) Filed: May 19, 2009

(65) Prior Publication Data

US 2009/0288993 A1 Nov. 26, 2009

(51) Int. Cl.
*C10G 29/16* (2006.01)

(52) U.S. Cl. ..... 502/84; 502/80; 502/400; 502/407; 502/414; 208/243; 208/244; 208/247; 208/249; 208/299

(58) Field of Classification Search ..... 502/80, 502/84, 400, 407, 414; 208/243–244, 247, 208/249, 299
See application file for complete search history.

(56) References Cited

U.S. PATENT DOCUMENTS

| | | | | |
|---|---|---|---|---|
| 6,132,518 | A | 10/2000 | Milnkovic et al. | |
| 6,150,300 | A | 11/2000 | Kahre et al. | |
| 7,462,732 | B2 | 12/2008 | Kim et al. | |
| 2003/0029777 | A1 | 2/2003 | Khare | |
| 2005/0020446 | A1 * | 1/2005 | Choudhary et al. | 502/407 |
| 2005/0279670 | A1 * | 12/2005 | Long et al. | 208/113 |

FOREIGN PATENT DOCUMENTS

| | | | |
|---|---|---|---|
| CN | 1110931 | A | 11/1995 |
| CN | 1151333 | A | 6/1997 |
| CN | 1258396 | | 6/2000 |
| CN | 1355727 | A | 6/2002 |
| CN | 1382071 | A | 11/2002 |
| CN | 1422177 | A | 6/2003 |
| CN | 1519297 | A | 8/2004 |
| CN | 1552802 | A | 12/2004 |
| CN | 1627988 | A | 6/2005 |

OTHER PUBLICATIONS

Yo, Y-G, et al. (2002), Catalysis Letters, 83(3-4), 157-160.

* cited by examiner

*Primary Examiner* — Walter D Griffin
*Assistant Examiner* — Brian McCaig
(74) *Attorney, Agent, or Firm* — Scully, Scott, Murphy & Presser, P.C.

(57) ABSTRACT

An adsorbent for desulfurizing cracking gasoline or diesel fuel comprising 1) pillared clay, (2) inorganic oxide binder, (3) an oxide of one or more metals selected from Groups IIB, VB and VIB, and (4) at least one metal accelerant selected from cobalt, nickel, iron and manganese. The adsorbent exhibits excellent abrasion-resistant strength and desulfurization performance.

15 Claims, 2 Drawing Sheets

Figure 1

DESULFURIZING ADSORBENT, PREPARING PROCESS AND USE THEREOF

FIELD OF THE INVENTION

The present invention relates to an adsorbent composition which is suitable for desulfurizing cracking gasoline or diesel fuel.

BACKGROUND OF THE INVENTION

With increasing recognition of environmental protection, environmental regulations are gradually becoming stricter. It is believed that decreasing the sulfur content in gasoline or diesel fuel is one of the most important measures to improve the air quality because the sulfur contained in the fuel adversely affects the performance of the catalytic converter of automobiles and vehicles. The sulfur oxides present in the exhaust gas from automobile engines inhibit the activity of the noble metal catalyst in the converter and poisons the catalyst irreversibly. Gases released from an ineffective or poisoned converter comprise uncombusted non-methane hydrocarbons, nitrogen oxide and carbon monoxide, all of which easily form photochemical smogs when catalyzed by sunlight.

In China, most sulfur contained in gasolines comes from heat processed gasoline, which is mainly catalytic cracking gasoline. Therefore, decreasing the sulfur content in the cracking gasoline would facilitate reducing sulfur content of these gasolines. The current standard for gasoline product is GB 17930-2006 "Motor Vehicle Gasoline," which further restricts the sulfur content of gasoline and requires that by Dec. 31, 2009 the sulfur content of gasoline be lowered to 50 ppm. This circumstance means that catalytic cracking gasoline must be desulfurized to a great degree in order to meet the environmental requirement.

When lowering the sulfur content of motor vehicle fuel, changes in olefin content which leads to a reduction of octane number (including Research Octane Number, ROM and Motor Octane Number, MON) should be avoided so to retain the combustion characteristics of the motor vehicle fuel. Generally, the negative change on the olefin content is caused by the hydrogenation reaction induced upon removal of thiophene compounds (including thiophene, benzothiophene, alkylthiophene, alkylbenzothiophene and alkyldibenzothiophene). Further, the loss of aromatic hydrocarbons in the cracking gasoline due to saturation under hydrogenation condition should also be avoided. Therefore, the most desirable approach is to desulfurize the gasoline while retaining its octane number.

On the other hand, both hydrodesulfurization and hydrogenation of unsaturated hydrocarbons consume hydrogen, which increases the operational cost of the desulfurization. Accordingly, there is a need for a method of desulfurization without consuming large volumes of hydrogen, thereby providing a more economical method for treatment of cracking gasoline or diesel fuel.

Traditionally, a fixed-bed process has been used for desulfurization in a liquid phase. However, this process is disadvantageous in the homogeneity of reaction and the regeneration of the material. Compared with the fixed-bed process, a fluidized-bed process is advantageous given wider applications prospects in the future because of better heat transfer and pressure drop. In this context, a fluidized-bed reactor is usually provided with granular reactants. However, for most reactions, the granular reactants do not have sufficient abrasion-resistance. Accordingly, it is of great significance to find a granular reactant, or adsorbent, with both excellent abrasion-resistance and desulfurization performance.

Chinese Patents CN 1110931A and CN 1151333A describe a new absorbing composition comprising zinc oxide, silicon dioxide, colloidal oxide and an accelerant and a process for making the same. In the process, fluidizable particles are produced by a pressure forming technique, and the particle pore volumes are increased by adding to the colloid a pore-forming agent which becomes flammable when heated. The particles prepared by this process are comparatively big, and the particle size is within the range of about 100 to about 300 micron, which is not most favorable for the fluidization process.

U.S. Pat. No. 6,150,300, Chinese Patents CN 1355727A and CN 1258396 disclose a granular adsorbent composition comprising a mixture of zinc oxide, silica, alumina, nickel or cobalt in a reduced state. The adsorbent is made by first mixing silica, alumina and zinc oxide under a shearing force, preparing the solid particle through a granulating machine, and impregnating nickel after drying and calcinating the particle. These patents do not disclose the physical-chemical properties, particularly the abrasion-resistance of the adsorbent, although the adsorbent disclosed in these patents reportedly show good desulfurization performance.

Chinese Patent CN 1422177A describes a process for making an adsorbent for removal of the sulfide contained in cracking gasoline. The process comprises the steps of impregnating an adsorbent carrier comprising zinc oxide, expanded perlite and alumina with accelerant metal such as cobalt and nickel, and subsequently reducing the accelerant at an appropriate temperature. The abrasion-resistance of the adsorbent can be improved by adjusting the level of zinc oxide and binder (particularly alumina from Disperal and Vista Dispal, Condea) in the adsorbent. Chinese Patent CN 1627988A further discusses in detail the major compounds produced under the reaction conditions. Chinese Patents CN 1856359 and CN 1871063 disclose that the physical-chemical properties of particles prepared by spray drying method in this patent are more suitable for fluidized-bed, as well as the particulars of adsorbents with similar constituents and a process of making the same.

In preparing these adsorbents, the strength of adsorbents is improved by adding clay. However, because the clay has no pores, the pore volume of the adsorbents tends to be smaller and thus the activity of the adsorbent decreases. Therefore, it is most desirable to have an adsorbent with high pore volume and high strength.

In view of the above, it is desirable to provide a new adsorbent composition for removing sulfur from cracking gasoline or diesel fuel and a process of making the adsorbent.

SUMMARY OF THE INVENTION

The present invention provides an adsorbent for removing sulfur from cracking gasoline or diesel fuel. The adsorbent has excellent abrasion-resistance and desulfurization activity.

The present invention also provides a process for making an adsorbent having such characteristics.

The present invention further provides a use of the subject adsorbent.

The adsorbent according to the invention comprises, based on the total weight of the adsorbent:

1) from about 5 to about 40 wt % of pillared clay,
2) from about 3 to about 35 wt % of inorganic oxide binder,
3) from about 10 to about 80 wt % of oxides of one or more metals selected from Groups IIB, VB and VIB, and 4) from about 5 to about 30 wt % of at least one metal accelerant selected from cobalt, nickel, iron and manganese.

Preferably, the pillared clay content is in the range of from about 15 to about 25 wt %, and the inorganic oxide binder content is in the range of from about 10 to about 15 wt %, and the metal oxide content is in the range of from about 40 to about 60 wt %, and the metal accelerant content is in the range of about 12 to about 20 wt %.

Preferably, the pillared clay is characterized by inter-layered mineral crystals composed of two single-layered mineral clay components arranged in an alternate manner, wherein the layer distance is no less than 1.7 nm and there is a strong peak at 3.4° in the XRD spectrum. Examples of such pillared clay include but are not limited to: rectorite, Yunmeng clay, bentonite, montmorillonite and smectite; rectorite is preferred. Rectorite belongs to layered clay with regularly inter-layered mineral structure. It is a crystalline mineral clay which is formed by arranging a non-expandable mica layer and an expandable smectite layer which sharing the adjacent 2:1 clay layer in an alternate and ordered manner. The composition is characterized in the strong peak at 3.4° in the XRD spectrum.

Preferably, the binder is one or more of heat resistant inorganic oxides, such as one or more inorganic oxides selected from alumina, silica, and amorphous silica-alumina, preferably alumina.

Preferably, the metal oxides can be oxides of one or more metals of Group IIB, VB and VIB metals or any other metal oxide having sulfur storage properties; oxides of vanadium, zinc or molybdenum are preferred; most preferably zinc oxide.

Preferably, the metal accelerant can be comprised of any metal capable of reducing oxidized sulfur to hydrogen sulfide. By way of example and without limitation, the metal accelerant at least comprises one or more metals selected from cobalt, nickel, iron, and manganese; preferably the metal accelerant contains nickel.

It must be noted that, as used in the specification and the appended claims, the singular forms "a", "an" and "the" include plural referents unless the context clearly dictates otherwise.

The term "cracking gasoline" as used herein means hydrocarbons having a boiling range of 40° C. to 210° C., or any fractions thereof produced by thermal cracking, or by catalytic cracking higher hydrocarbon molecules into smaller molecules. Suitable thermal cracking processes include but are not limited to pyrolysis, thermal cracking, visbreaking thermal and combinations thereof. Examples of suitable catalytic cracking process include but are not limited to fluidized-bed catalytic cracking and heavy oil catalytic cracking and combinations thereof. Particularly suitable catalytic cracking gasolines include but are not limited to coked gasoline, thermal cracking gasoline, visbreaking gasoline, fluidized-bed catalytic cracking gasoline, heavy oil cracking gasoline and combinations thereof. According to the process of the invention, it is possible in some cases to fractionate and/or hydrogenate the cracking gasoline prior to desulfurization when used as hydrocarbon-containing fluid.

The term "diesel fuel" as used herein means any hydrocarbon mixture or any fractions thereof with boiling range of 170° C. to 450° C. Such hydrocarbon containing fluids include but are not limited to light cycle oil, kerosene, straight-run diesel oil, hydrogenated diesel oil and the combination thereof.

The term "sulfur" as used herein means the element sulfur in any form, such as organic sulfide existing in hydrocarbon containing liquids, including as cracking gasoline or diesel fuel. Sulfur contained in the hydrocarbon-containing liquid according to the present invention includes but is not limited to carbonyl sulfide (COS), carbon disulfide ($CS_2$), mercaptans or other thiophene compounds and the combination thereof, particularly thiophene, benzothiophene, alkylthiophene, alkylbenzothiophene, and alkyldibenzothiophene, and thiophene compounds having higher molecular weight which are usually contained in diesel fuel.

The present invention also provides a process for preparing an adsorbent, comprising the steps of:

(1) contacting pillared clay, an inorganic oxide binder precursor and an acidic solution to form a slurry;

(2) adding an oxide of one or more metals selected from Groups IIB, VB and VIB to the slurry to form a carrier mixture;

(3) molding, drying and calcinating the carrier mixture to form a carrier;

(4) introducing a compound component comprising at least one metal accelerant selected from one or more of cobalt, nickel, iron and manganese to the carrier, and drying and calcinating the carrier to form an adsorbent precursor; and (5) obtaining the absorbent by reducing the adsorbent precursor in hydrogen containing atmosphere so that the accelerant metal is substantially present in a reduced state.

According to a preferred method of preparing the adsorbent according to the invention, the pillared clay of step (1) includes but is not limited to rectorite, Yunmeng clay, bentonite, montmorillonite and smectite; with rectorite preferred.

The inorganic oxide binder precursor preferably represents a material which can form a heat-resistant inorganic oxide during the process of making the adsorbent. For example, the precursor of alumina can be selected from hydrated alumina and/or aluminum sol; the hydrated alumina is selected from one or more of boehmite, pseudo-boehmite, alumina trihydrate, amorphous aluminum hydroxide. The precursor of silica can be selected from one or more of silica sol, silica gel and water glass. The precursor of amorphous silica-alumina can be selected from one or more of silica-alumina gol, mixture of silica sol and alumina sol, and silica-alumina gel. These precursors of heat-resistant inorganic oxides are known to the ordinary person skilled in the art.

The acidic solution that is used in contacting the pillared clay and the inorganic oxide binder component is selected from one or more of water-soluble inorganic acid and/or organic acid, preferably one or more of hydrochloric acid, nitric acid, phosphoric acid and acetic acid. The amount of acid used is such that the pH of the slurry is between about 1 to about 5, preferably between about 1.5 to about 4. In step (2), an oxide of one or more metals selected from Groups IIB, VB and VIB, preferably an oxide of vanadium, zinc or molybdenum etc. are added to the slurry of step (1). The oxide can be added directly as powder or a pre-formed oxide slurry may be added. Those methods are known to the ordinary person skilled in the art. The carrier mixture thus obtained can be in the form of wet mixture, dough, paste, or slurry. The mixture is subsequently molded into an extrudate, sheet, pellet, sphere, or microspheric particle. For example, the mixture can be molded (preferably extruded) into particles, or preferably be molded into a cylindrical extrudate with a diameter of about 1.0 to about 8.0 mm and a length of about 2.0 to about 5.0 mm when it is a dough or paste mixture. The extrudate thus obtained is subsequently dried and calcinated. The carrier mixture produced can be thickened, dried and molded when it is in a form of wet mixture. More preferably, the carrier mixture can be molded by spray drying into microspheres with a particle size of about 20 to about 200 microns when it is in the form of a slurry. To facilitate spray drying, the slurry has a solids content of about 10 to about 50 wt. %, preferably about 20 to about 50 wt. % before drying.

The methods and conditions for drying the carrier mixture are known to the ordinary person skilled in the art. The drying methods include without limitation airing, baking, and blow drying. The drying temperature can be in the range of from about room temperature to about 400° C., preferably between about 100° C. to about 350° C.

The calcinating conditions for the carrier mixture are also known to the ordinary person skilled in the art. Generally, the calcinating temperature is between about 400° C. to about 700° C., preferably about 450° to about 650° C., and the calcinating time is at least about 0.5 hour, preferably about 0.5 to about 100 hours, more preferably about 0.5 to about 10 hours.

In the process according to the present invention, the metal accelerant can be introduced into the carrier by impregnation or precipitation techniques well known in the art. The impregnation can be performed by impregnating the calcinated carrier with a solution or suspension of a compound component containing the metal accelerant. The precipitation can be performed by first mixing the solution or suspension containing the compound component with the carrier, and then adding ammonia to precipitate the metal accelerant onto the carrier. The metal accelerant can be transformed into a metal oxide when calcined. The compound component comprising the metal accelerant is preferably selected from acetates, carbonates, nitrates, sulfates, sulfocyanides and oxides of accelerant metals, e.g. cobalt, nickel, iron, and/or manganese, and mixtures of any of the foregoing. The metal accelerant preferably contains nickel.

The composition that results from the introduction of the metal accelerant is preferably dried at between about 50° C. to about 300° C., preferably between about 100° C. to about 250° C., for a time between about 0.5 to about 8 hours, preferably about 1 to about 5 hours. Thereafter, the composition is preferably calcinated at between about 300° C. to about 800° C., preferably between about 450° C. to about 750° C. in the presence of oxygen or an oxygen-containing atmosphere for a time between about 0.5 to about 4 hours, preferably between about 1 to about 3 hours. The adsorbent precursor is obtained once volatile materials are removed and the accelerant metals are transformed into metal oxide.

The adsorbent precursor is reduced at between about 300° C. to about 600° C. under a hydrogen or a hydrogen-containing atmosphere; the adsorbent of the invention is obtained when the accelerant metals are in a substantially reduced state. Preferably, the reduction temperature is between about 400° C. to about 500° C., and the hydrogen content of the atmosphere is between about 10 to about 60 vol. %, and the reduction time is between about 0.5 to about 6 hours, more preferably between about Ito about 3 hours.

The present invention further provides a method for desulfurizing cracking gasoline or diesel fuel, comprising fully contacting the sulfur containing material to be desulfurized, with the adsorbent according to the invention, at a between about 350° C. to about 500° C., preferably between about 400° C. to about 450° C., during which the sulfur contained in the material is adsorbed in the adsorbent and thus a product having low sulfur content is obtained. The adsorbent can be recycled after going through oxidation-reduction regeneration process.

The adsorbent prepared from pillared clay according to the present invention has very high abrasion-resistance and large pore volume. It is suitable for use in the desulfurization process and can greatly increase the life of the adsorbent.

$$\{(Na_{0.72}K_{0.02}Ca_{0.05})(Ca_{0.24}Na_{0.07})\}(Al_{4.00}Mg_{0.02})[Si_{6.58}Al_{1.62}]O_{22}$$

Wherein $(Na_{0.72}K_{0.02}Ca_{0.05})$ represents stationary interlayer cation; $(Ca_{0.24}Na_{0.7})$ represents exchangeable interlayer cation; $(Al_{4.00}Mg_{0.02})$ represents hexacoordinated ion; $[Si_{6.58}Al_{1.62}]$ represents tetracoordinated ion.

Figure 1:
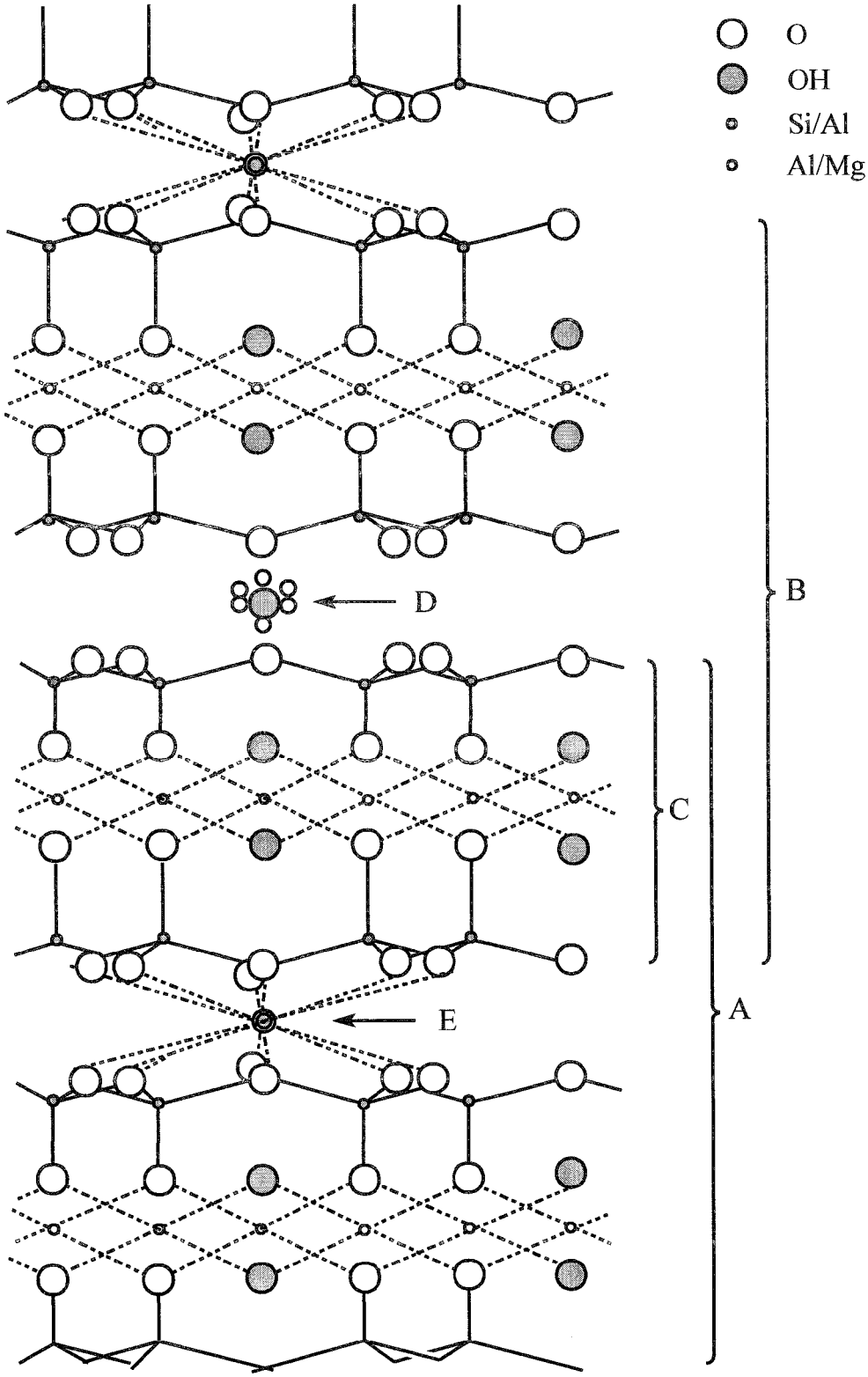
FIG. 1 is a schematic structure of rectorite used herein, wherein A is non-expandable mica layer, B is expandable smectite layer, C is clay layer, D is exchangeable cation in smectite layer, and E is stationary cation in mica layer. The layer distance (d001) of the rectorite is 1.9-2.9 nm, the chemical formula of the rectorite is as follows.
Figure 2:
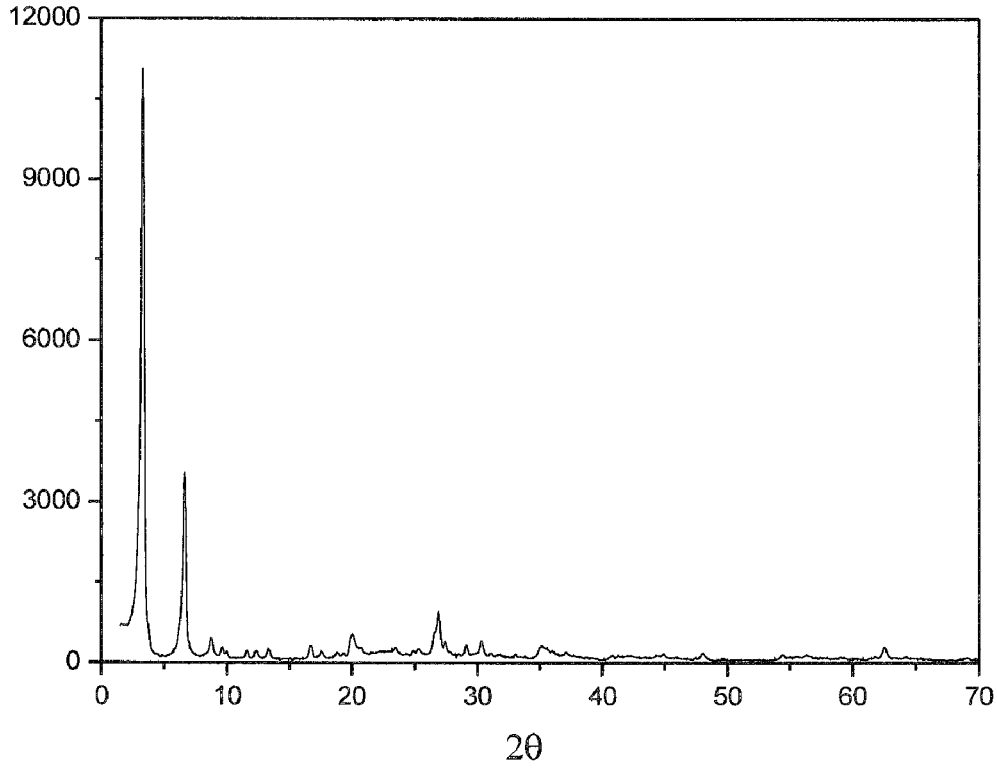

FIG. 2 is an x-ray diffraction pattern of rectorite. The rectorite is characterized in a strong peak at 3.4° (characteristic peak), which is related to the pillar height. The XRD is measured on D5005 X-ray diffractometer from Siemens, with Cu target, $K_\alpha$ radiation, solid detector, tube voltage of 40 kV, and tube current of 40 mA.

DETAILED DESCRIPTION OF THE INVENTION

While embodiments of the present disclosure are described in connection with the above embodiments and the corresponding text and figures, there is no intent to limit the claims to the embodiments in these descriptions. On the contrary, the intent is to cover all alternatives, modifications, and equivalents included within the spirit and scope of embodiments of the present disclosure.

The present invention will be further illustrated with reference to the following examples, but not limited thereby.

The desulfurization effect is measured based on the sulfur content in the product which is analyzed by offline chromatography.

Example 1

The adsorbent was prepared as follows: 3.36 kg of powder zinc oxide (from Beijing Chemical Works) and 4.57 kg of deionized water were mixed, and subsequently stirred for 30 minutes to obtain zinc oxide slurry.

1.56 kg of alumina (from Shandong Aluminum Corporation, having a dry basis of 1.14 kg) and 2.13 kg of rectorite (having a dry basis of 1.70 kg, available from Qilu Petrochemical Catalyst Company) were mixed under stirring, and then added with 3.6 kg of deionized water for uniform mixing, subsequently added with 300 ml 30% HCl (chemically pure, available from Beijing Chemical Works) under stirring for acidifying for 1 hour, and finally heated to 80° C. for aging for 2 hours. A zinc oxide slurry was added and mixed under stirring for 1 hour to obtain the carrier slurry, which was spray dried using a Niro Bowen Nozzle Tower™ spray drier, with a pressure of 8.5-9.5 MPa, an inlet temperature of less than 500° C., and an outlet temperature of about 150° C. The microspheres thus produced were dried at 180° C. for 1 hour, and then calcinated at 635° C. for 1 hour to obtain the adsorbent carrier.

6.4 kg of the adsorbent carrier was spray impregnated with 7.56 kg of nickel nitrate hexahydrate and 1.10 kg of deionized water twice, and the resultant mixture was dried at 180° C. for 4 hours and calcinated at 635° C. for 1 hour to produce the adsorbent precursor which was composed of 42 wt. % of zinc oxide, 14.3 wt. % of alumina binder, 21.2 wt. % of rectorite, and 22.5 wt. % of nickel oxide. The precursor was reduced under hydrogen atmosphere at 425° C. for 2 hours to produce an adsorbent, which is reported as A1 in Table 1.

Example 2

The adsorbent was prepared as follows: 4.56 kg of powder zinc oxide (from Beijing Chemical Works) and 5.57 kg of deionized water were mixed, and subsequently stirred for 30 minutes to obtain zinc oxide slurry.

1.10 kg of alumina (from Shandong Aluminum Corporation, having a dry basis of 0.8 kg) and 1.50 kg of rectorite (having a dry basis of 1.20 kg, available from Qilu Petrochemical Catalyst Company) were mixed under stirring, and then added with 2.8 kg of deionized water for uniform mixing, subsequently added with 275 ml 30% HCl (chemically pure, available from Beijing Chemical Works) under stirring for acidifing for 1 hour, and finally heated to 80° C. for aging for 2 hours. A zinc oxide slurry was added and mixed under stirring for 1 hour to obtain the carrier slurry, which was spray dried using a Niro Bowen Nozzle Tower™ spray drier, with a pressure of 8.5-9.5 MPa, an inlet temperature of less than 500° C., and an outlet temperature of about 150° C. The microspheres thus produced were dried at 180° C. for 1 hour, and then calcinated at 635° C. for 1 hour to obtain the adsorbent carrier.

The active ingredient nickel was introduced as shown in Example 1 to produce the adsorbent precursor which was composed of 57 wt. % of zinc oxide, 10.0 wt. % of alumina binder, 15.0 wt. % of rectorite, and 18.0 wt. % of nickel oxide. The reduced adsorbent is reported as A2.

Comparative Example 1

The adsorbent was prepared according to the method of Example 1 except that diatomite was used instead of pillared rectorite. The precursor was composed of 49 wt. % of zinc oxide, 11.5 wt. % of alumina binder, 19.0 wt. % of diatomite, and 20.5 wt. % of nickel oxide. The reduced adsorbent is reported as B1.

Comparative Example 2

The adsorbent was prepared according to the method of Example 1 except that expanded perlite was used instead of pillared rectorite. The precursor was composed of 54 wt. % of zinc oxide, 10.5 wt. % of alumina binder, 16.6 wt. % of expanded perlite, and 18.9 wt. % of nickel oxide. The reduced adsorbent is reported as B2.

Example 3

Both abrasion-resistant strength and desulfurization performance of the adsorbents prepared by as above were measured. The strength of the adsorbent was measured by straight tube abrasion in accordance with the method of RIPP 29-90 described in "Petrochemical Analysis Method (RIPP experimentation)." The following methods were employed to evaluate the desulfurization performance of these adsorbents. A fixed-bed micro-reaction system was used to evaluate the desulfurization performance of the adsorbents. The material for the adsorbing reaction was catalytic cracking gasoline having a sulfur content of 800 ppm. The adsorbing test was performed under hydrogen atmosphere at the temperature of 410° C. and weight space velocity of 4 $h^{-1}$. The sulfur contents of the gasoline as well as the adsorbents after desulfurization were analyzed, and the results are reported in Table 1.

TABLE 1

Abrasion-resistant strength and desulfurization performance of different adsorbents

| | Adsorbent | | | | |
|---|---|---|---|---|---|
| | A1 | A2 | B1 | B2 | B3 |
| Abrasion-resistance | 4.7 | 5.7 | 11.3 | 10.5. | 5.8 |
| Sulfur content of gasoline/ ppm | 28 | 16 | 25 | 22 | 53 |
| Sulfur content of adsorbent/wt. % | 11.1 | 12.3 | 11.9 | 12.1 | 8.9 |

As shown by the results in Table 1, adsorbents A1 and A2 according to the present invention had superior abrasion-resistant strength and significantly lower sulfur content in the adsorbed products.

Comparative Example 3

The adsorbent was prepared according to the method applied in Example 2 except that kaolin was used instead of pillared rectorite. The precursor was composed of 52 wt. % of zinc oxide, 11.5 wt. % of alumina binder, 17.6 wt. % of kaolin, and 18.9 wt. % of nickel oxide. The reduced adsorbent is reported as B3.

Many variations and modifications may be made to the above-described embodiments. All such modifications and variations are intended to be included herein within the scope of this disclosure and protected by the following claims.

What is claimed is:

1. An adsorbent for desulfurizing cracking gasoline or diesel fuel comprising:

1) from about 5 to about 40 wt % of rectorite, 2) from about 3 to about 35 wt % of inorganic oxide binder, 3) from about 10 to about 80 wt % of oxides of one or more metals selected from Groups IIB, VB and VIB, and 4) from about 5 to about 30 wt % of at least one metal accelerant selected from cobalt, nickel, iron and manganese, based on the total weight of the adsorbent.

2. The adsorbent of claim 1 wherein the rectorite content is in the range of from about 15 to about 25 wt %, and the binder content is in the range of from about 10 to about 15 wt %, and the metal oxide content is in the range of from about 40 to about 60 wt %, and the metal accelerant content is in the range of about 12 to about 20 wt %.

3. The adsorbent of claim 1 wherein the inorganic oxide binder is selected from one or more of alumina, silica, and amorphous silica-alumina.

4. The adsorbent of claim 1 wherein the metal oxide is selected from oxide of vanadium, zinc or molybdenum.

5. The adsorbent of claim 1 wherein the metal accelerant comprises nickel.

6. A process for preparing the adsorbent of claim 1, comprising the steps of:

(1) contacting rectorite, an inorganic oxide binder precursor and an acidic solution to form a slurry;

(2) adding an oxide of one or more metals selected from Groups IIB, VB and VIB to the slurry to form a carrier mixture;

(3) molding, drying and calcinating the carrier mixture to form a carrier;

(4) introducing a compound component comprising at least one metal accelerant selected from one of more of cobalt, nickel, iron and manganese to the carrier, and drying and calcinating the carrier to form an adsorbent precursor; and (5) obtaining the adsorbent by reducing the adsorbent precursor in hydrogen containing atmosphere so that the accelerant metal is substantially present in a reduced state.

7. The process of claim 6 wherein (a) the inorganic oxide binder precursor is selected from one or more of hydrated alumina and/or aluminum sol; (b) the inorganic oxide binder precursor is selected from one or more of silica sol, silica gel and water glass; or (c) the inorganic oxide binder precursor is selected from one or more of silica-alumina gel, mixture of silica sol and alumina sol, and silica-alumina gel.

8. The process of claim 6 wherein the slurry of Step (1) has a pH of between about 1 to about 5.

9. The process of claim 6 wherein in Step (2) an oxide of vanadium, zinc or molybdenum is added to the slurry.

10. The process of claim 6 wherein in Step (3) the carrier mixture is in the form of a slurry and the molding is by spray drying; the drying temperature for the carrier mixture is at a temperature between about room temperature to about 400° C.; and the calcinating is at a temperature between about 400° C. to about 700° C.

11. The process of claim 6 wherein in Step (4) the compound component comprising the metal accelerant is introduced in the carrier by impregnation or precipitation; the compound component comprising the metal accelerant being selected from acetates, carbonates, nitrates, sulfates, sulfocyanides and oxides of cobalt, nickel, iron and/or mangansese and mixtures of any of the foregoing.

12. The process of claim 6 wherein the metal accelerant contains nickel.

13. The process of claim 6 wherein in Step (4) the drying is carried out at a temperature of between about 50° C. to about 300° C.; and the calcinating is carried out at about 300° C. to about 800° C. in the presence of oxygen.

14. The process of claim 6 wherein in Step (5) the adsorbent precursor is reduced at a temperature of between about 300° C. to about 600° C. under a hydrogen atmosphere.

15. A process for desulfurizing cracking gasoline or diesel fuel comprising contacting a sulfur-containing material with the adsorbent of claim 1 at a temperature of between about 350° C. to about 500° C. to produce a low sulfur content product.

* * * * *